US006305552B1

(12) United States Patent
Coleman

(10) Patent No.: US 6,305,552 B1
(45) Date of Patent: Oct. 23, 2001

(54) APPARATUS FOR REMOVING MATTER FROM TOBACCO STEMS

(75) Inventor: G. A. John Coleman, Richmond, VA (US)

(73) Assignee: Universal Leaf Tobacco Company, Inc., Richmond, VA (US)

( * ) Notice: Subject to any disclaimer, the term of this patent is extended or adjusted under 35 U.S.C. 154(b) by 0 days.

(21) Appl. No.: 09/522,037

(22) Filed: Mar. 9, 2000

Related U.S. Application Data

(60) Provisional application No. 60/124,018, filed on Mar. 12, 1999.

(51) Int. Cl.[7] ..... B07B 13/05; B07B 1/50

(52) U.S. Cl. ..... 209/664; 209/293; 209/298; 209/379; 209/389

(58) Field of Search ..... 209/664, 298, 209/299, 297, 296, 294, 293, 288, 284, 379, 389

(56) References Cited

U.S. PATENT DOCUMENTS

| | | | | |
|---|---|---|---|---|
| 260,407 | | 7/1882 | Payne . | |
| 393,944 | * | 12/1888 | Vivarttas | 209/404 |
| 926,281 | | 6/1909 | McGoffin . | |
| 1,139,041 | * | 5/1915 | Larson | 209/384 |

(List continued on next page.)

OTHER PUBLICATIONS

Wagner et al., US Statutory Invention Registration #H31, Published Mar. 4,1986.*

*Primary Examiner*—Donald P. Walsh
*Assistant Examiner*—Daniel K. Schlak

(74) *Attorney, Agent, or Firm*—Pillsbury Winthrop LLP

(57) ABSTRACT

An apparatus for separating tobacco stem particles from a mixture containing such particles and tobacco stalk particles obtained in a threshing and separating process employed in a tobacco stemmery includes a hollow drum having a longitudinal axis, the hollow drum being mounted for rotational movement about its axis and the axis being disposed at a slight angle with respect to the horizontal so as to establish a higher inlet end and a lower outlet end of the hollow drum. A mixture handling structure is constructed and arranged with respect to the inlet end of the hollow drum to feed a supply of a mixture containing tobacco stem particles and tobacco stalk particles obtained in the threshing and separating process into the inlet end of the hollow drum. The hollow drum has a periphery formed of a foraminus structure that includes a plurality of generally axially extending parallel bars spaced apart a distance sufficient to allow the passage of tobacco stem particles therethrough while substantially preventing the passage of tobacco stalk particles therethrough. A power operated assembly rotates the hollow drum about its axis at a speed sufficient to cause a portion of the mixture entering the inlet end and falling on the lowermost bars which has not passed through the spaces between the bars to be carried through a cycle which includes an upward movement with the movement of the bars and a falling movement downwardly onto the lowermost bars at a position downstream and a repetition of the cycle until the remaining mixture is moved out the lower outlet end of the hollow drum. A tobacco stem handling structure below the hollow drum receives the tobacco stem particles passing through the spaces between the bars as the particles of the mixture are cycled within the rotating hollow drum and moves the tobacco stem particles away. A tobacco stalk particle handling structure at the outlet end of the hollow drum receives the remaining mixture moved out of the lower outlet end of the hollow drum and moves the remaining mixture away.

19 Claims, 10 Drawing Sheets

U.S. PATENT DOCUMENTS

| | | | | |
|---|---|---|---|---|
| 1,304,253 | * | 5/1919 | Bird | 209/389 |
| 1,343,292 | | 6/1920 | Turner . | |
| 1,598,419 | * | 8/1926 | Bonaventura | 209/394 |
| 1,677,862 | | 7/1928 | Herrold . | |
| 2,119,676 | * | 6/1938 | Heller | 209/379 |
| 2,316,986 | * | 4/1943 | Parker | 209/627 |
| 2,458,887 | | 1/1949 | Winters . | |
| 2,533,357 | * | 12/1950 | Crawford | 209/664 |
| 2,652,588 | * | 9/1953 | Harris | 452/15 |
| 2,915,182 | * | 12/1959 | Burnet et al. | 209/294 |
| 3,729,096 | | 4/1973 | Fitzner et al. . | |
| 4,078,995 | | 3/1978 | Utt . | |
| 4,240,589 | * | 12/1980 | Martin et al. | 241/81 |
| 4,635,860 | * | 1/1987 | Kruyer | 241/23 |
| 4,857,180 | * | 8/1989 | Eriksson | 209/664 |
| 4,927,528 | * | 5/1990 | Doppstadt | 209/31 |
| 4,935,124 | * | 6/1990 | Daugherty et al. | 209/664 |
| 6,082,550 | * | 7/2000 | Metzner et al. | 209/294 |

* cited by examiner

APPARATUS FOR REMOVING MATTER FROM TOBACCO STEMS

The present application claims priority from the U.S. Provisional Application Ser. No. 60/124,018 filed Mar. 12, 1999, which is hereby incorporated by reference in its entirety into the present application for all material disclosed therein.

FIELD OF THE INVENTION

The present invention is generally related to an apparatus for removing matter from tobacco during tobacco processing and more particularly to a separator for separating tobacco stalks and foreign matter from tobacco stems.

BACKGROUND OF THE INVENTION

It is well known that some types of tobacco are harvested by removing individual ripe leaves from the stalk of a standing tobacco plant to allow the remaining leaves to remain in the field to continue to grow and that other types of tobacco are harvested by removing from the field the entire tobacco stalk with the tobacco leaves still attached. The stalk is the main trunk of the tobacco plant that supports the tobacco leaves, each of which is attached to the stalk by a stem. The stem is the mid-rib of the tobacco leaf.

When tobacco is harvested by removing the entire stalk from the field, the tobacco leaves are typically cured on the stalk. After curing, tobacco farmers strip the leaves from the stalk so that the leaves can be marketed. Pieces of stalk sometimes find their way into the tobacco sold by tobacco farmers because the farmers do not always break the leaves from the stalk cleanly when they strip them. In burley tobacco production, for example, where tobacco is cured on the stalk, careless removal of the cured leaves from the stalk can result in pieces of stalk in the product.

Stalks most often end up in the tobacco product when tobacco leaves are harvested individually using mechanical harvesters for curing in bulk curing barns. Thus, it can be appreciated that although the leaves are always removed from the stalk before marketing regardless of the harvesting or curing method used, stalks frequently end up mixed in with the leaves and must be removed in a subsequent processing step.

In the threshing and separating processes employed in a tobacco stemmery, the tobacco is usually mechanically threshed and then separated onto various components. The cut tobacco forms a mixture that includes leaf parts (lamina or strip), stems, stalk parts and soil particles. As the tobacco is processed, the useful tobacco components of the mixture are separated out and the unusable portion of the mixture is discarded. When leaf tobacco is processed for use in cigarettes, chewing-tobacco or cigars, the useable end-products are the leafy particles (sometimes referred to as the "strip"), the stems, and the small leaf particles (sometimes referred to as the "fines"). The undesirable end-products are soil particles, any other non-tobacco products and the stalks. This undesirable material must be removed from the tobacco during processing.

The leaf parts and leaf particles are relatively easy to separate from the rest of the cut tobacco by, for example, exposing the threshed tobacco mixture to a vertical moving air current. Any stalks present in the mixture usually remain in the mixture with the stems after the leaf fraction is removed. However, because the stalks and stems typically have the same density, the stems must be separated from the non-usable material in a separate subsequent processing step.

Tobacco stems are used in tobacco product manufacture in one of two ways. The larger stems (greater than one and one half inches) are conditioned, rolled, cut and expanded to produce a product similar in characteristics to cut leaf tobacco. The smaller stems are ground into a pulp and mixed with the tobacco fines, water and binders to form a slurry from which reconstituted tobacco is made. In both cases, it is very important that the stems are free of non-tobacco products and stalks.

The traditional means for removing the stalks from the stems is by manually inspecting the tobacco and passing the stems over a vibrating conveyor containing a screen comprised of longitudinal rods spaced about three eighths of an inch apart. Although this method works most of the time, the screen tends to choke with the longer stems and requires frequent attention. Therefore, there exists a need in the tobacco processing business for a simpler, more efficient and more economical way to remove the stalks from processed tobacco stems.

SUMMARY OF THE INVENTION

To meet the need expressed above, there is disclosed and described herein an apparatus for separating tobacco stem particles from a mixture containing such particles and tobacco stalk particles obtained in a threshing and separating process employed in a tobacco stemmery. The apparatus is comprised of a hollow drum or reel having a longitudinal axis, the hollow drum being mounted for rotational movement about its axis and the axis being disposed at a slight angle with respect to the horizontal so as to establish a higher inlet end and a lower outlet end of the hollow drum. A mixture handling structure is constructed and arranged with respect to the inlet end of the hollow drum to feed a supply of a mixture containing tobacco stem particles and tobacco stalk particles obtained in the threshing and separating process into the inlet end of the hollow drum. The hollow drum has a periphery formed of a foraminus structure that includes a plurality of generally axially extending parallel bars spaced apart a distance sufficient to allow the passage of tobacco stem particles therethrough while substantially preventing the passage of tobacco stalk particles therethrough. A power operated assembly rotates the hollow drum about its axis at a speed sufficient to cause a portion of the mixture entering the inlet end and falling on the lowermost bars which has not passed through the spaces between the bars to be carried through a cycle which includes an upward movement with the movement of the bars and a falling movement downwardly onto the lowermost bars at a position downstream and a repetition of the cycle until the remaining mixture is moved out of the lower outlet end of the hollow drum. A tobacco stem handling structure below the hollow drum receives the tobacco stem particles passing through the spaces between the bars as the particles of the mixture are cycled within the rotating hollow drum and moves the tobacco stem particles away. A tobacco stalk particle handling structure at the outlet end of the hollow drum receives the remaining mixture moved out of the lower outlet end of the hollow drum and moves the remaining mixture away.

The stalk removal apparatus cleans itself as the hollow drum tumbles the mixture but, if a stem or stalk becomes entrapped between the bars, a cleaning device in the form of a blockage clearing mechanism operates periodically to dislodge it. In this way, the stalk removal apparatus cleans itself continuously. The stalk or stem cleared from between the bars by the blockage clearing mechanism is returned to the reject product contained within the hollow drum. The blockage clearing mechanism is operatively associated with the upper exterior periphery of the hollow drum and is constructed and arranged to move particles lodged in the spaces between the bars downwardly during the rotational movement of the hollow drum. An additional advantage of the apparatus is that the tumbling action of the mixture on the dry stems dislodges any remaining attached leaf lamina. The dislodged leaf lamina is reclaimed as fines in a subsequent system designed for this purpose. Processing of the mixture in the apparatus produces clean, polished stems that are attractive to the customer.

Another objective of the invention is to provide a separator comprising a hollow drum having a longitudinal axis, the drum being mounted for rotational movement about its axis and the axis being disposed at a slight angle with respect to the horizontal so as to establish a higher inlet end and a lower outlet end of the drum. A feeding structure is constructed and arranged with respect to the inlet end of the hollow drum to feed thereto a supply of a mixture containing first and second size fractions. The hollow drum has a periphery formed of a foraminus structure including generally axially extending parallel bars that are spaced apart from one another a distance sufficient to allow the passage of the first size fraction of the mixture therethrough, while substantially preventing the passage of the second size fraction therethrough. A power operated assembly is provided for rotating the hollow drum about its axis at a speed sufficient to cause a portion of the mixture entering the inlet and falling on the lowermost bars which has not passed through the spaces between the bars to be carried through a cycle which includes an upward movement with the movement of the bars and a falling movement downwardly onto the lowermost bars at a position downstream and a repetition of this cycle until the remaining mixture is moved out of the lower outlet end of the hollow drum. A first size fraction handling structure is positioned below the hollow drum and is constructed and arranged to receive the first size fraction passing through the spaces between the bars as the mixture is cycled within the rotating hollow drum and to move the first size fraction away. A second size fraction handling structure is positioned at the outlet end of the hollow drum and is constructed and arranged to receive the remaining mixture moved out of the lower outlet end of the hollow drum and to move the remaining mixture away. A blockage clearing mechanism is operatively associated with the upper exterior periphery of the hollow drum and is constructed and arranged to move material lodged in the spaces between the bars downwardly during the rotational movement of the hollow drum.

A further objective of the present invention is to provide a method of separating tobacco stem particles from a mixture containing such particles and tobacco stalk particles obtained in a threshing and separating process employed in a tobacco stemmery. The method utilizes a hollow drum having a longitudinal axis, the drum being mounted for rotational movement about its axis and the axis being disposed at a slight angle with respect to the horizontal so as to establish a higher inlet end and a lower outlet end of the hollow drum. The hollow drum has a periphery formed of a foraminus structure that includes generally axially extending parallel bars spaced apart from one another a distance sufficient to allow the passage of tobacco stem particles therethrough while substantially preventing the passage of tobacco stalk particles therethrough. The method can be understood as comprising (1) feeding to the inlet end of the hollow drum a supply of a mixture containing tobacco stem particles and tobacco stalk particles obtained in a threshing and separating process employed in a tobacco stemmery; (2) moving the mixture with respect to the hollow drum by rotating the hollow drum about its axis at a speed sufficient to cause a portion of the mixture entering the inlet and falling on the lowermost bars which has not passed through the spaces between the bars to be carried through a cycle which includes an upward movement with the movement of the bars and a falling movement downwardly onto the lowermost bars at a position downstream and a repetition of this cycle until the remaining mixture is moved out of the lower outlet end of the hollow drum; (3) receiving the tobacco stem particles passing through the spaces between the bars as the particles of the mixture are cycled within the rotating hollow drum and moving the tobacco stem particles away, and (4) receiving the remaining mixture moved out of the lower outlet end of the hollow drum and moving the remaining mixture away. The method may include feeding the supply of mixture to the inlet end of the hollow drum from a stem dryer. It is contemplated that the method further utilizes a blockage clearing mechanism that is operatively associated with an upper exterior periphery of the hollow drum, the blockage clearing mechanism being constructed and arranged to move particles lodged in the spaces between the bars downwardly during the rotational movement of the drum, and that the method further includes moving particles lodged in the spaces between the bar downwardly during the rotational movement of the drum with the blockage clearing mechanism.

Other objects, features, and advantages of the present invention will become apparent from the following detailed description, the accompanying drawings, and the appended claims.

DETAILED DESCRIPTION OF THE DRAWINGS

Figure 1:
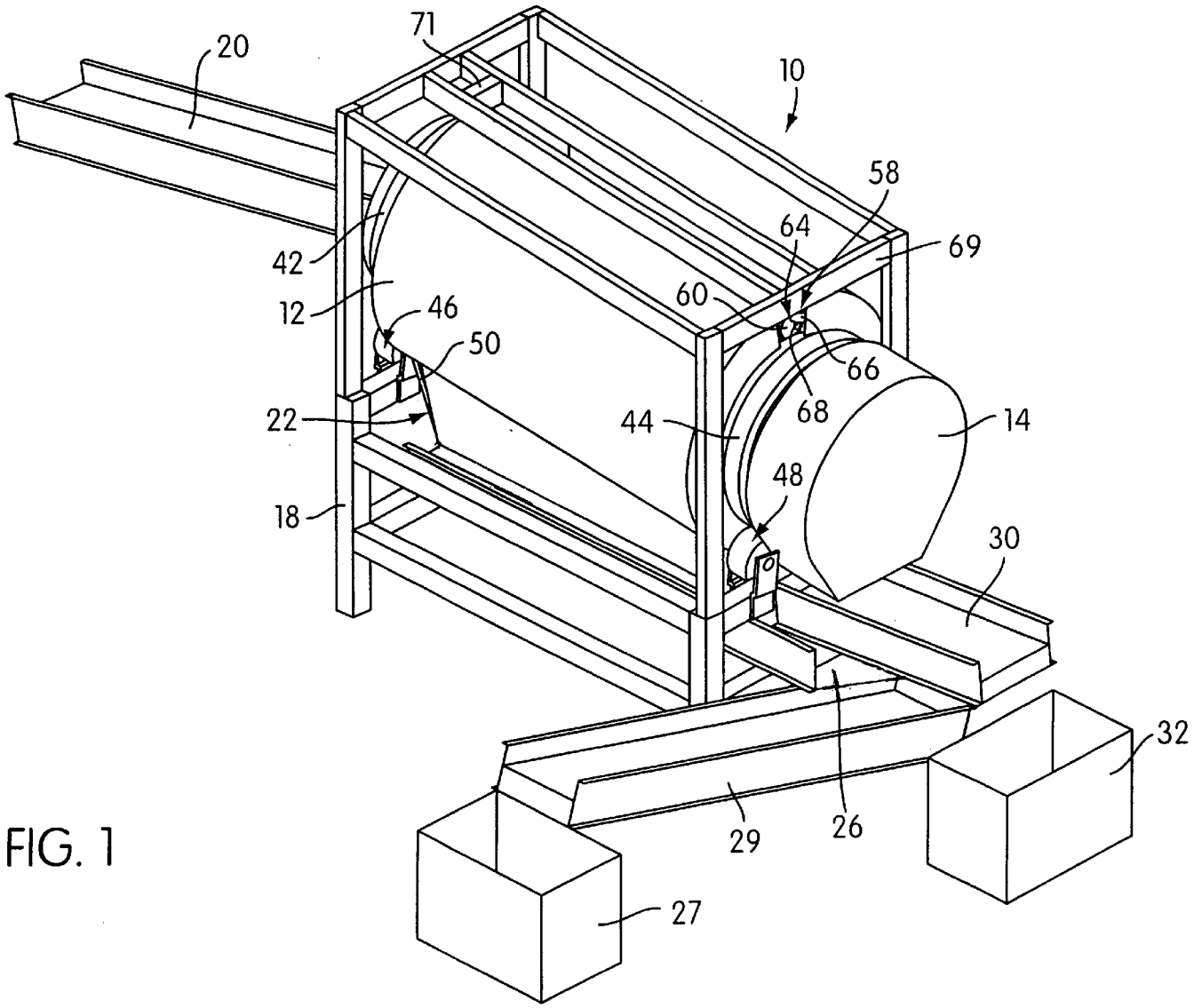
FIG. 1 is a perspective view of a stalk removing apparatus constructed according to the principles of the present invention.

FIG. 1 shows the preferred embodiment and best mode of a stalk removing apparatus, generally designated 10, constructed according to the principles of the invention for separating tobacco stem particles from a mixture containing such particles and tobacco stalk particles obtained in a threshing and separating process employed in a tobacco stemmery.

Figure 2:
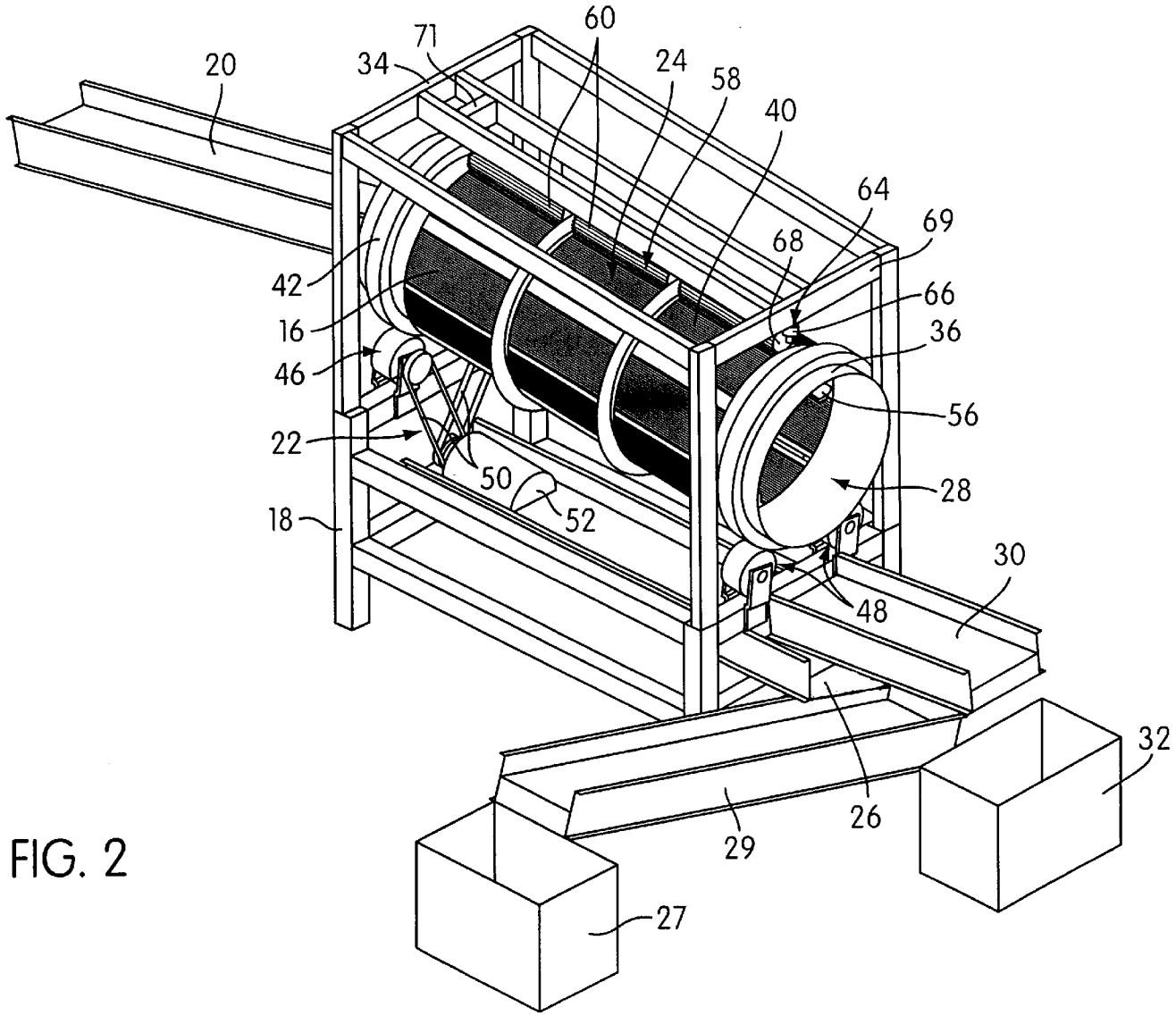
FIG. 2 is a perspective view of the stalk removing apparatus similar to the view of FIG. 1 but with a central shroud, an outlet shroud and a tobacco stem handling structure removed to reveal internal structures of the apparatus.

FIG. 2 is a view of the stalk removing apparatus 10 similar to the view of FIG. 1 except showing the apparatus 10 with a plurality of structures removed including a central shroud 12 and an outlet shroud 14 to more clearly illustrate portions of the stalk removing apparatus 10. As shown in FIG. 2, the stalk removing apparatus 10 is comprised of a hollow drum or reel 16 rotatably mounted within a rigid frame structure 18. The frame structure 18 is preferably a metal structure made of tubular steel that has been welded together to form the frame.

The drum 16 is positioned within the frame structure 18 to receive through an inlet opening in the drum a stream of the mixture from a mixture handling structure 20 which conveys the mixture to the apparatus 10. The mixture handling structure 20 can be a conventional conveyor belt assembly as shown schematically in the figures or any other suitable structure. Alternatively, the drum can also be manually loaded.

As will become apparent, as the mixture is fed into the drum 16, the drum 16 is rotated with respect to the frame structure 18 at a predetermined rate by a power operated assembly, generally designated 22, and the rotational movement of the drum 16 effects the separation of the stems from the mixture by repeatedly dropping the mixture against a foraminus structure 24 on the exterior (i.e., the periphery) of the drum 16. The foraminus structure 24 allows the stems to pass therethrough while retaining the unusuable portion of the mixture in the drum 16 interior. The stems fall onto a tobacco stem handling structure 26 located below the stalk removing apparatus 10 and the tobacco stem handling structure 26 conveys the stems to a stem hopper 27. The tobacco stem handling structure 26 can be a conventional conveyor belt assembly as shown schematically in the figures (or any other appropriate structure) and can be powered by the power operated assembly 22. An auxiliary conveyor belt assembly can be provided as shown schematically in the figures and used in conjunction with the tobacco stem handling structure 26 to move the stems to the hopper 27.

The fraction of the mixture (which includes the stalks) that is unable to pass through the foraminus structure 24 advances through the drum 16 and out an outlet opening 28 in the end of the drum onto a tobacco stalk particle handling structure 30 positioned at the outlet end of the drum 16. The tobacco stalk particle handling structure 30, which can be a conventional conveyor belt assembly as shown schematically in the figures or other appropriate structure, conveys the stalks and non-tobacco material to a collection hopper 32.

The stalk removal drum 16 is a hollow, open-ended cylindrical structure rotationally mounted within the frame structure 18 for rotation about a longitudinal axis of the drum. Preferably the longitudinal axis of the rotating cylindrical drum 16 is inclined at about five degrees to the horizontal so that the inlet opening is slightly higher than the outlet opening 28.

Figure 3:
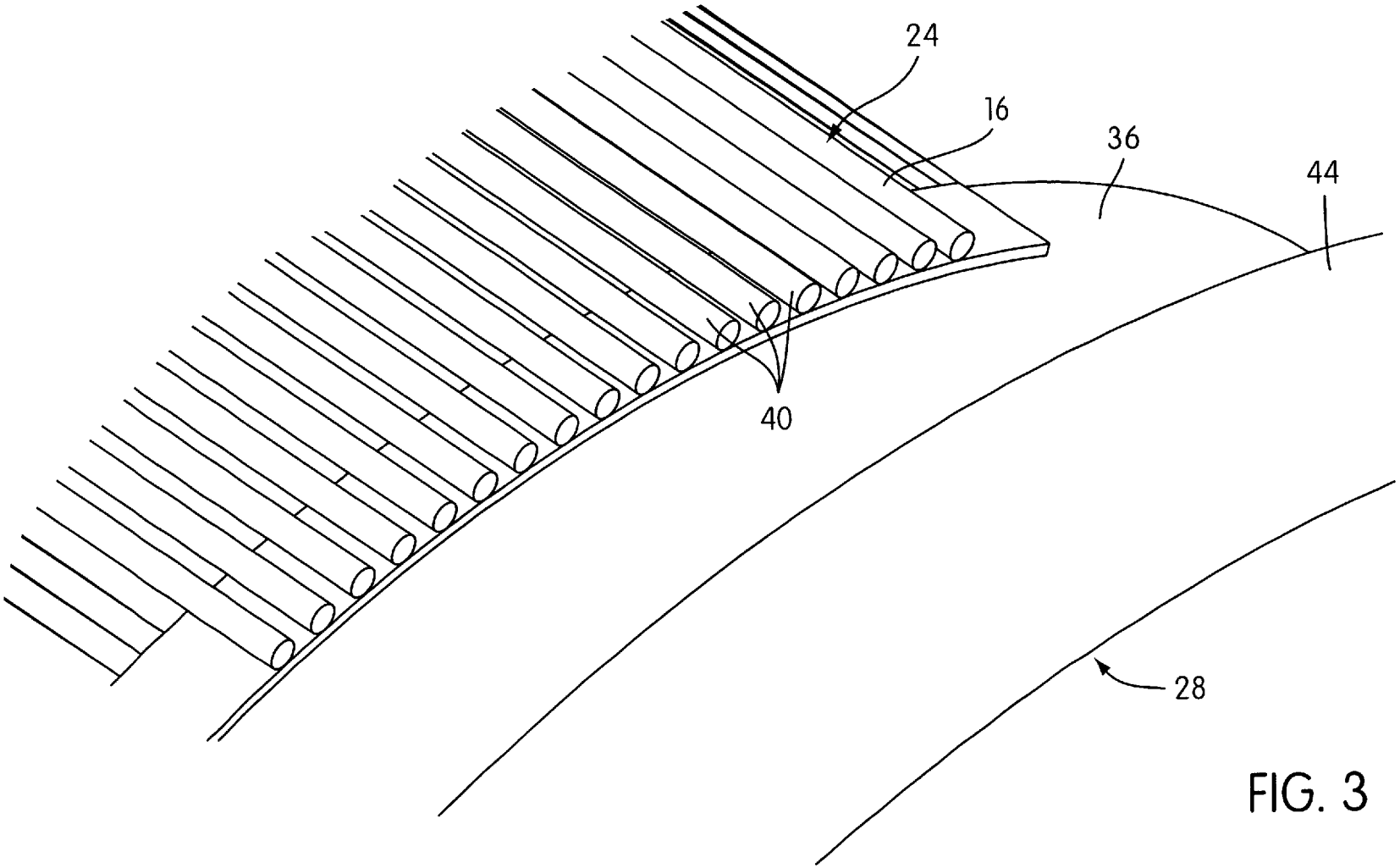
FIG. 3 is an enlarged perspective view of a fragment of a drum of the stalk removing apparatus showing a plurality of parallel bars thereof.

The drum 16 is constructed of metal and has a solid sheet metal entry tube 34 proximate the inlet opening and a solid sheet metal exit tube 36 proximate the outlet opening 28. A plurality of generally axially extending parallel bars 40 are secured between the entry tube 34 and the exit tube 36. The parallel bars 40 form the outer periphery of the drum 16 and comprise the foraminus structure 24 thereof. The parallel bars 40 are spaced apart a distance sufficient to allow the passage of tobacco stem particles through the parallel bars 40 while substantially preventing the passage of tobacco stalk particles to the tobacco stem handling structure 26. In the preferred embodiment, each parallel bar 40 is made of a metal such as steel, each has a one half inch diameter and each is spaced from adjacent rods to form openings three eighths of an inch wide around the periphery of the drum 16. FIG. 3 shows an enlarged fragmentary view of a portion of the drum 16 at the outlet opening 28 end thereof to show a portion of the foraminus structure 24 formed by the parallel bars 40.

A forward trunnion ring 42 is mounted to the drum 16 proximate the inlet opening and a rearward trunnion ring 44 is mounted to the drum 16 proximate the outlet opening 28. The trunnion rings 42, 44 are preferably made of a metal such as steel and are affixed to the drum in any appropriate manner such as, for example, by welding. The trunnion rings 42, 44 engage and are supported by a forward pair and rearward pair of trunnion wheels, 46, 48, respectively, that are mounted for rotational movement to the frame structure 18. The forward pair of trunnion wheels 42 is rotationally coupled through a pair of conventional drive belts 50 to a variable speed electric drive motor 52 which forms part of the power operated assembly 22. The motor 52 is mounted generally below the conveyor belt assembly 26. The conveyor belt assembly 26 has been removed from the apparatus 10 in FIG. 2 to show the construction and arrangement of the power operated assembly 22. The motor 52 is rigidly secured to the frame structure 18.

Figure 4:
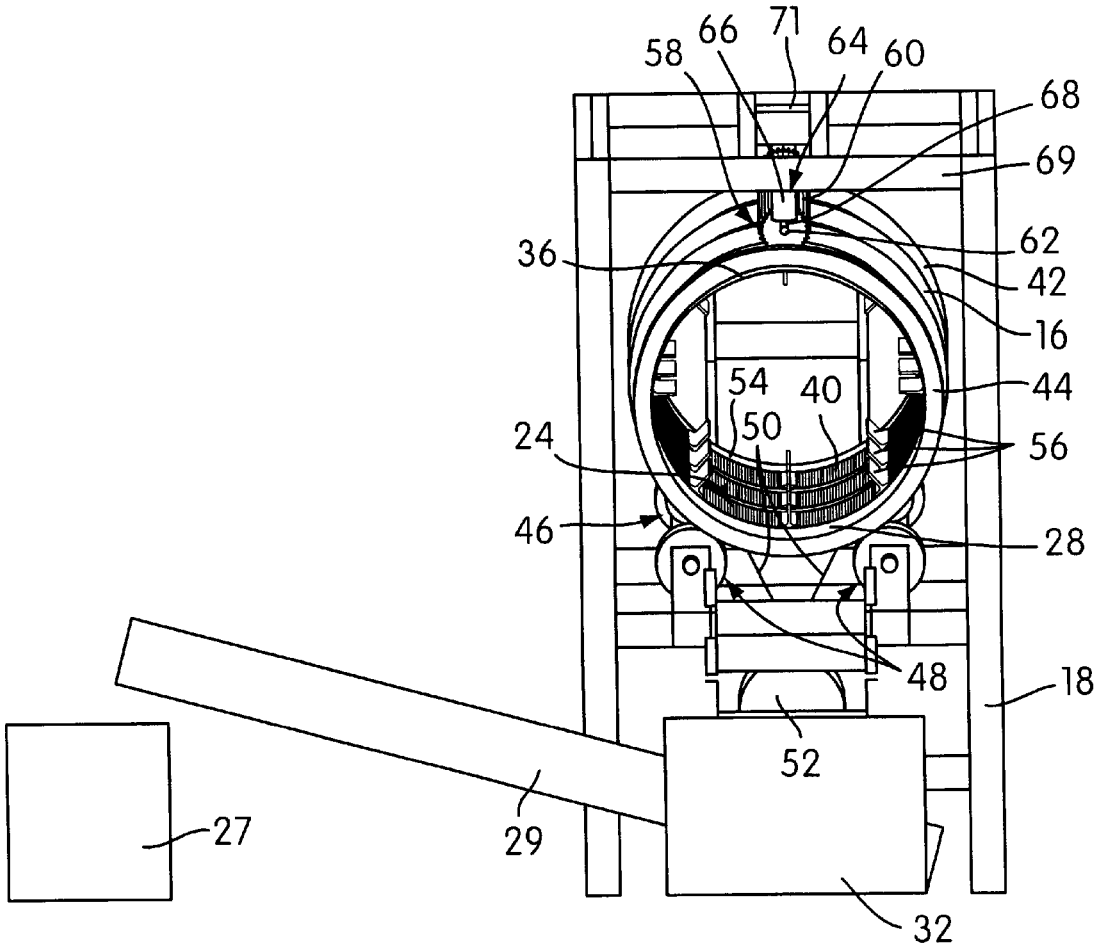
FIG. 4 is an end view of the stalk removing apparatus of FIG. 2.

FIG. 4 shows an end view along a horizontal line of sight of the stalk removing apparatus 10 with the shrouds 12, 14 removed. FIG. 4 is a view looking into the outlet opening 28 toward the inlet opening 54 and illustrates the preferred five degree incline of the drum 16 along its longitudinal axis. FIG. 4 also shows that a plurality of longitudinally extending blades or flights 56 (or other appropriate structure) are rigidly mounted inside the drum 16. The blades 56 are preferably metal structures and are symmetrically circumferentially spaced about the interior of the drum and secured thereto by welding or any other suitable means. The blades serve to lift and drop the mixture as the drum rotates.

Figure 5:
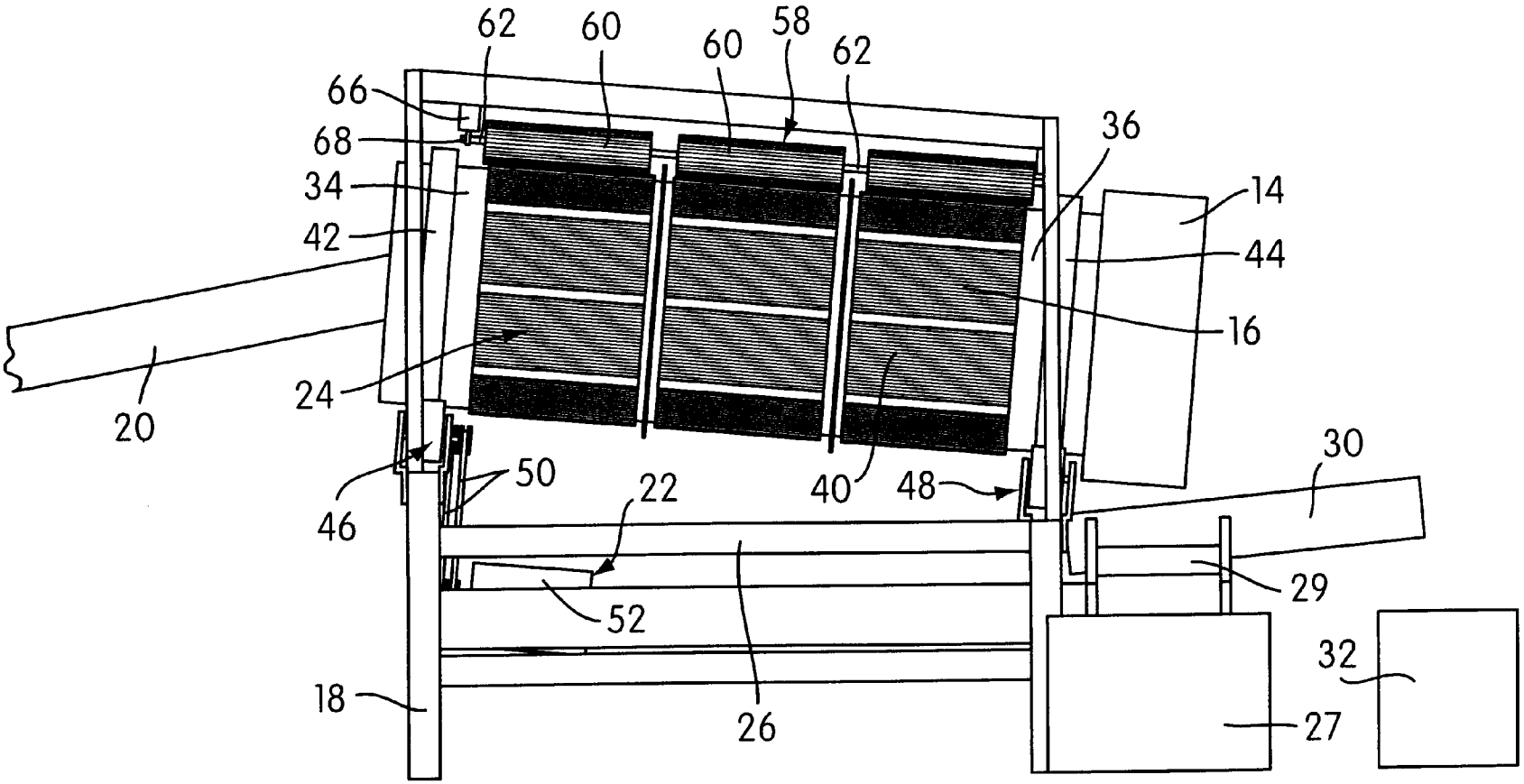
FIG. 5 is an elevational view of the stalk removing apparatus of FIG. 2.
Figure 6:
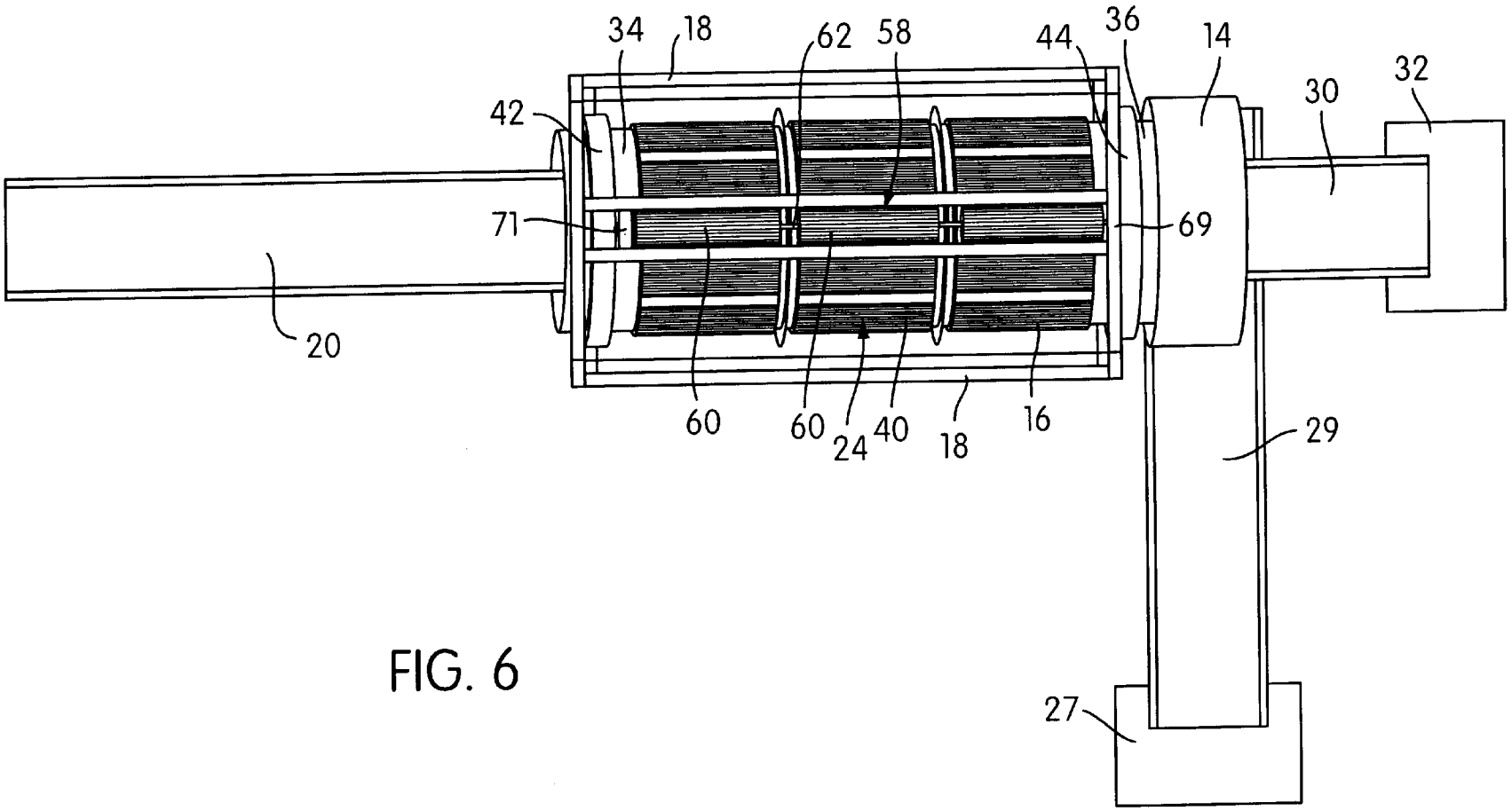
FIG. 6 is top plan view of the stalk removing apparatus of FIG. 2.

Stalk pieces in the mixture are generally larger than three eighths of an inch in diameter and the stems are generally smaller than three eighths of an inch in diameter so the stems pass through the spaces formed between the parallel bars 40 and the stalks remain inside the drum 16. Those stems and stalks that are close to three eighths of an inch in diameter may become lodged between two adjacent parallel bars 40 of the screen, partially blocking the space therebetween. To dislodge them, a blockage clearing mechanism 58 is provided at the top of the drum 16. FIGS. 4–6, for example, illustrate that the blockage clearing mechanism 58 is operatively associated with the upper exterior periphery of the hollow drum 16. The blockage clearing mechanism 58 is constructed and arranged to move particles lodged in the spaces between the parallel bars 40 out of the spaces so that the particles fall downwardly to the bottom of the drum 16 during the rotational movement of the same.

The blockage clearing mechanism 58 consists of a plurality of floating elongated gears 60 preferably made of a synthetic material. The teeth on the elongated gears 60 engage and partially extend through the spaces between the parallel bars 40 to force the trapped particles back inside the drum. The elongated gears 60 are each rotationally mounted on an individual shaft 62 that is supported at each end by a piston and cylinder device 64. Each cylinder 66 is mounted to the frame structure 18 and the piston 68 is secured to an end of the shaft 62 so the elongated gears 60 are moved in and out of engagement with the parallel bars 40 of the drum 16 by moving the pistons 68 together upwardly or downwardly in the cylinders 66.

Figure 7:
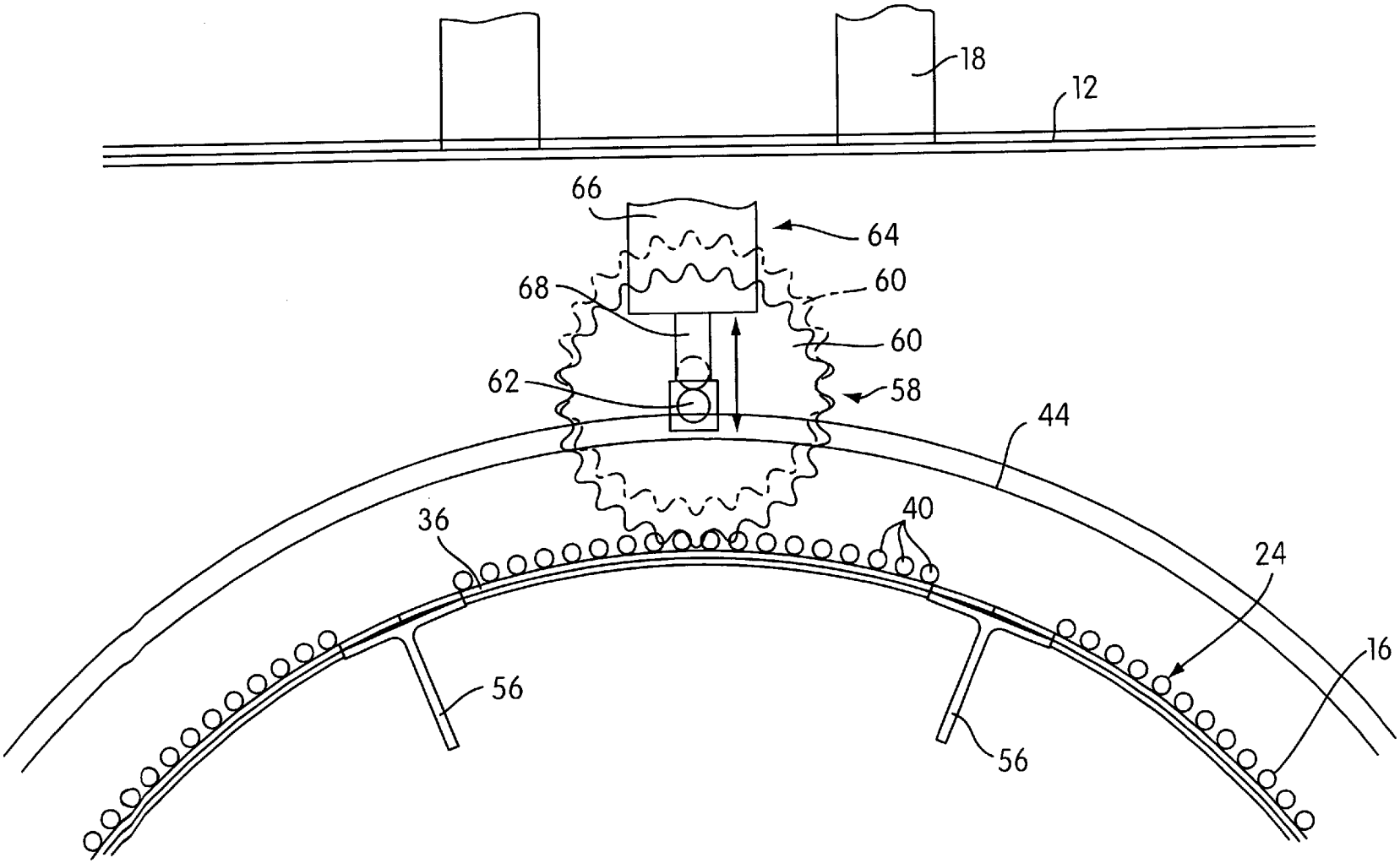
FIG. 7 is an enlarged view of a fragmentary of the drum showing an elongated gear in solid lines engaged with the drum and showing in phantom lines the elongated gear in a retracted position out of engagement with the drum.

This movement is illustrated in FIG. 7 which shows an elongated gear 60 in two positions: an elongated gear 60 is shown in solid lines operatively engaged with the parallel bars 40 on the drum 16 and is shown in broken (or dashed) lines in a retracted position realized when the pistons 68 (only one of which is visible in FIG. 7) are drawn into their respective cylinders 66. It will be understood by one skilled in the art that each piston and cylinder device 64 is in fluid communication with a controlled source of pressurized fluid (preferably compressed air) through a plurality of conventional hydraulic hoses. The fluid pressure source and the hydraulic hoses are not shown to more clearly illustrate the invention.

Figure 8:
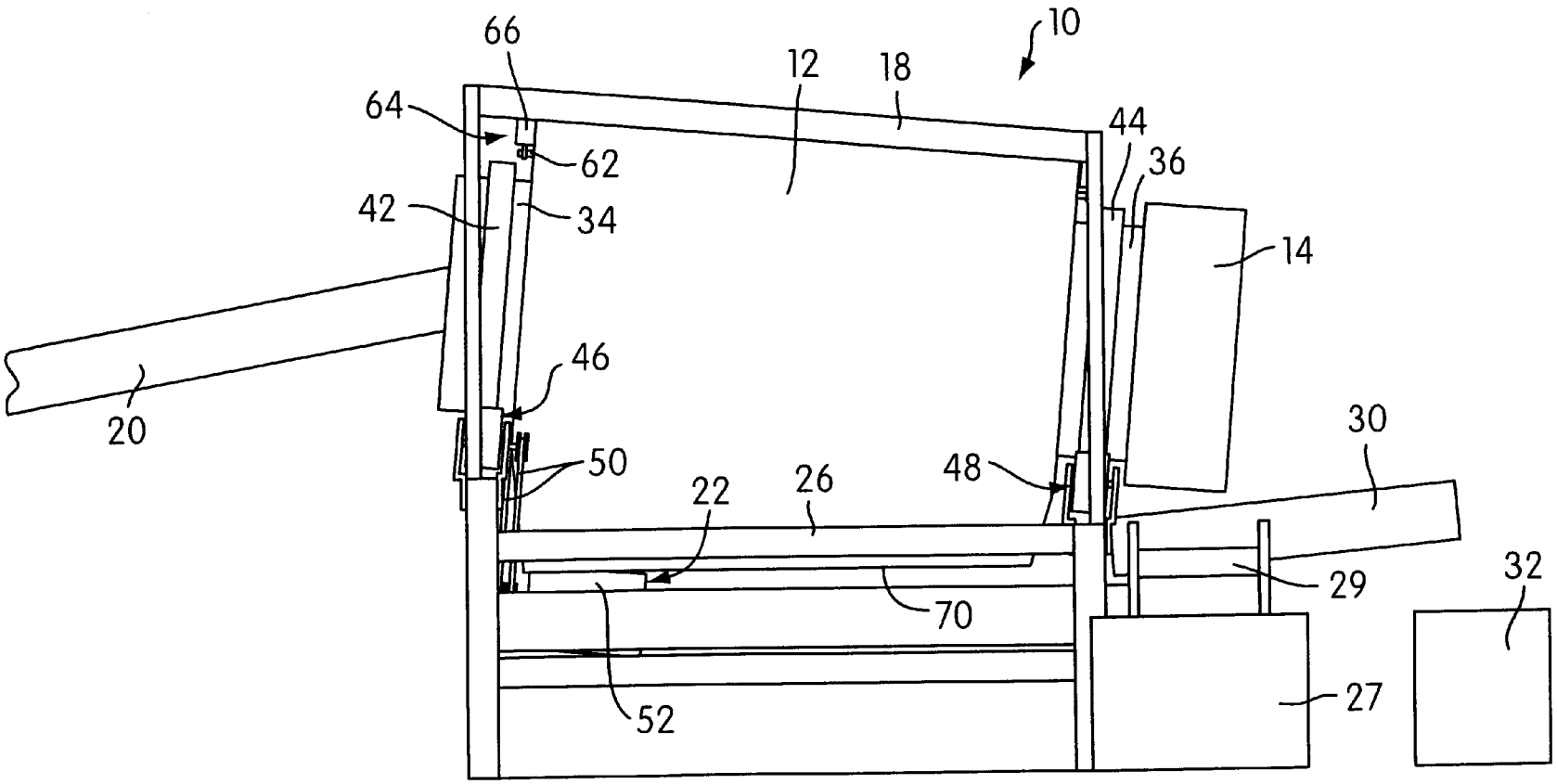
FIG. 8 is an elevational view of the stalk removing apparatus of FIG. 1.
Figure 9:
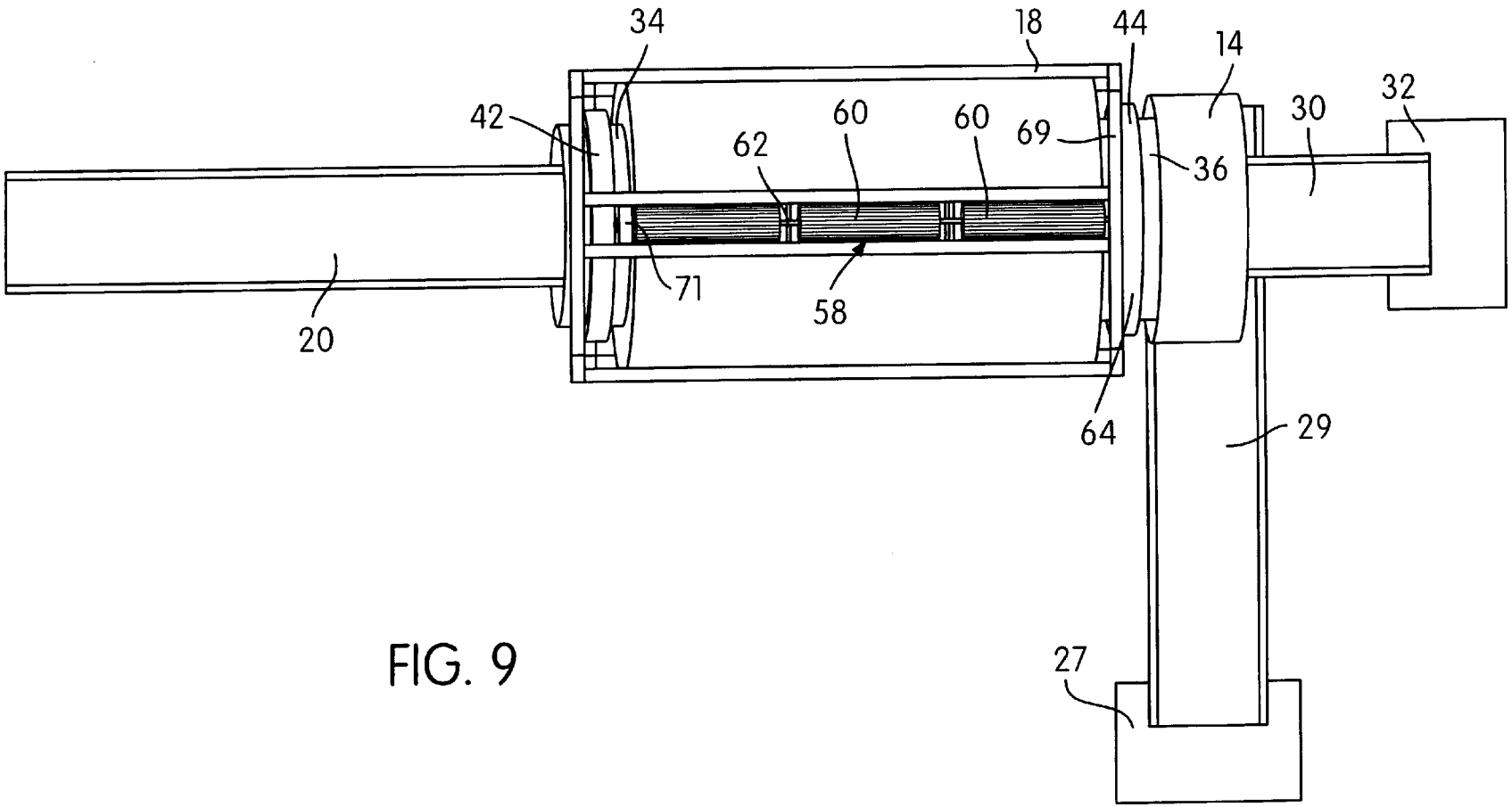
FIG. 9 is top plan view of the stalk removing apparatus of FIG. 1.
Figure 10:
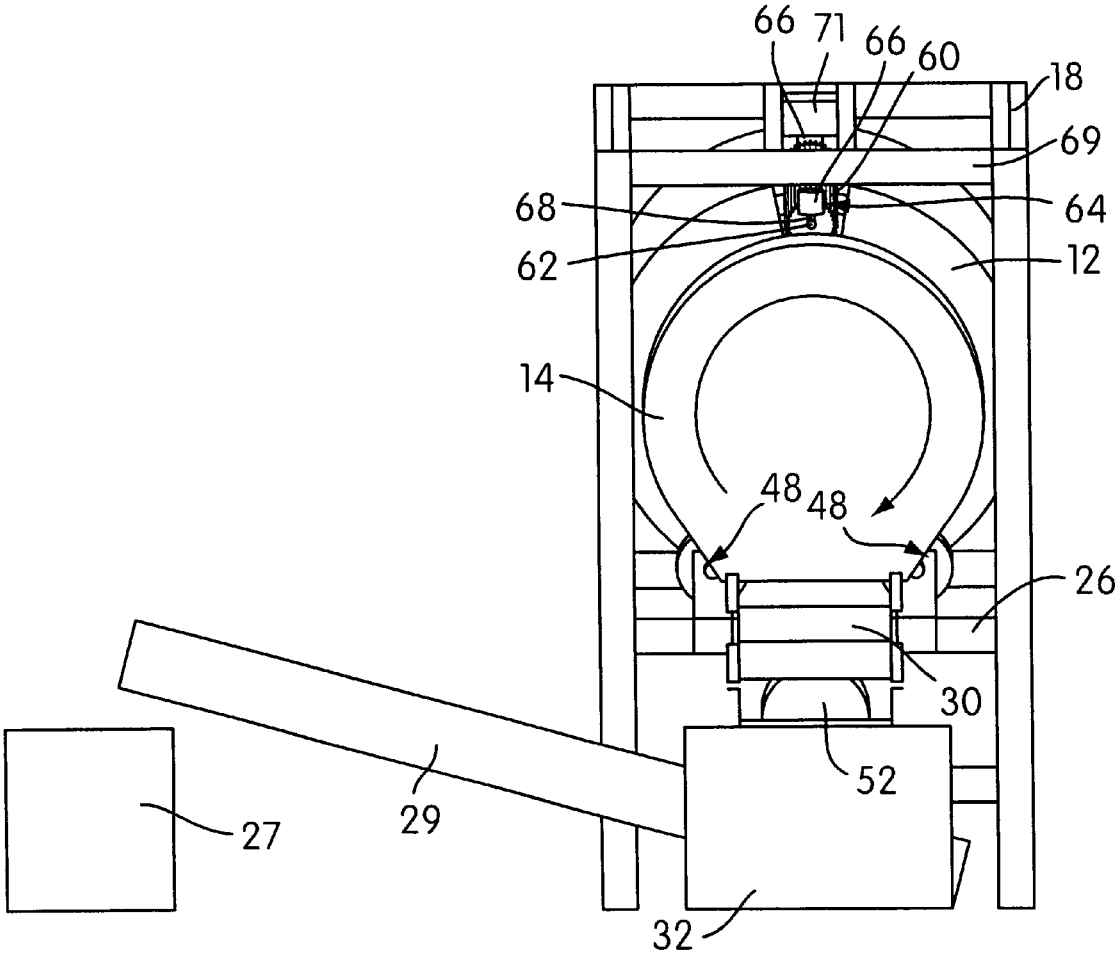
FIG. 10 is an end view of the stalk removing apparatus of FIG. 1.

FIGS. 8–10 show the stalk removing apparatus 10 with the central shroud 12 and the outlet shroud 14 installed on the apparatus 10. The central shroud 12 is a removable structure preferably made of sheet metal that generally surrounds the drum to contain any dust generated by the churning of the mixture within the drum 16. The central shroud 12 has a bottom opening that directs the stems that fall through the screen onto the tobacco stem handling structure 26. The outlet shroud 14 is preferably a sheet metal structure that helps contain dust and directs the fraction of the mixture that does not pass through the foraminus structure 24 onto the tobacco stalk particle handling structure 30 for collection in that collection hopper 32.

It can be appreciated that it is within the scope of the invention to provide an apparatus 10 for separating tobacco stem particles from a mixture containing such particles and tobacco stalk particles obtained in a threshing and separating process employed in a tobacco stemmery, the apparatus comprising a hollow drum 10 having a longitudinal axis, the drum being mounted for rotational movement about its axis and the axis being disposed at a slight angle with respect to the horizontal so as to establish a higher inlet end and a lower outlet end of the drum 10. The apparatus further includes a mixture handling structure 20 that is constructed and arranged with respect to the inlet end of the hollow drum 16 to feed thereto a supply of a mixture containing tobacco stem particles and tobacco stalk particles obtained in a threshing and separating process employed in a tobacco stemmery. The hollow drum 16 has a periphery formed of a foraminus structure including generally axially extending parallel bars 40 spaced apart a distance sufficient to allow the passage of tobacco stem particles therethrough while substantially preventing the passage of tobacco stalk particles therethrough. A power operated assembly for rotating the hollow drum about its axis at a speed sufficient to cause a portion of the mixture entering the inlet and falling on the lowermost bars which has not passed through the spaces between the bars 40 to be carried through a cycle which includes an upward movement with the movement of the bars and a falling movement downwardly onto the lowermost bars at a position downstream and a repetition of the cycle until the remaining mixture is moved out of the lower outlet end of the hollow drum. A tobacco stem handling structure 26 is positioned below the hollow drum 16 and is constructed and arranged to receive the tobacco stem particles passing through the spaces between the bars 40 as the particles of the mixture are cycled within the rotating hollow drum 16 and to move the tobacco stem particles away. A tobacco stalk particle handling structure 30 is positioned at the outlet end of the hollow drum 16 and is constructed and arranged to receive the remaining mixture that has moved outwardly through the lower outlet end of the hollow drum and move the remaining mixture away.

Preferably, a blockage clearing mechanism 58 is operatively associated with the upper exterior periphery of the hollow drum 16. The blockage clearing mechanism 58 is constructed and arranged to move particles lodged in the spaces between the bars 40 downwardly during the rotational movement of the hollow drum 16. Preferably, the blockage clearing mechanism 58 is constructed and arranged for movement between an operative position (indicated by the solid line representation of the mechanism 58 in FIG. 7, for example) in which the blockage clearing mechanism 58 is operatively associated with the drum 16 as aforesaid and an inoperative position (indicated by the broken or dashed line representation of the mechanism 58 in FIG. 7) in which the blockage clearing mechanism 58 is spaced from the drum 16. Preferably, the blockage clearing mechanism 58 is comprised of a plurality of elongated gears (although it is understood that it is within the scope of the invention to construct an embodiment of the apparatus 10 in which the blockage clearing mechanism is provided by a single elongated gear) mounted on an upper portion of the exterior of the drum 16, the gears having teeth constructed and arranged to meshingly engage the bars 40 and to extend into the spaces between the bars 40 to move the lodged particles downwardly into the interior of the drum 16 during the rotational movement of the drum.

Preferably, a plurality of axially extending mixture lifting structures (such as the blades or flights 56) are circumferentially spaced about an interior portion of the drum 16 for rotational movement therewith, each mixture lifting structure 56 being constructed and arranged to lift the portion of the mixture falling on the lowermost bars which has not passed through the spaces between the bars 40 upwardly with the upward movement of the bars and to drop the portion downwardly onto the lowermost bars at a downstream position as each of the mixture lifting structures reaches an upper portion of the drum interior.

It can also be understood that although the central shroud 12 and the outlet shroud 14 are not required, preferably they are included as part of the apparatus 10. The central shroud 12 generally surrounds the hollow drum 16 and is constructed and arranged to contain dust generated by the movement of the portion of the mixture within the drum 16. The central shroud 12 has a bottom opening constructed and arranged to direct stems falling through the bars 40 onto the tobacco stem handling structure 26. The outlet shroud 14 generally surrounds the outlet opening of the drum 16 and is constructed and arranged to contain the dust generated by drum rotation and to direct the portion of the mixture that passes through the outlet opening of the drum 16 onto the tobacco stalk particle handling structure 30. Preferably, the mixture handling structure 20 is provided by a first conveyor belt assembly, the tobacco stem handling structure 26 is provided by a second conveyor belt assembly, the second conveyor belt assembly being constructed and arranged to move the stem particles away to a stem container 27, and the tobacco stalk particle handling structure 30 is provided by a third conveyor belt assembly, the third conveyor belt assembly being constructed and arranged to move the stalk particles away to a stalk container 32.

It can also be understood that is it within the scope of the invention to provide separator 10 comprising a hollow drum 16 having a longitudinal axis, the drum 16 being mounted for rotational movement about its axis and the axis being disposed at a slight angle with respect to the horizontal so as to establish a higher inlet end and a lower outlet end of the drum 16. A feeding structure 20 is constructed and arranged with respect to the inlet end of the hollow drum 16 to feed thereto a supply of a mixture containing first and second size fractions. The hollow drum 16 has a periphery formed of a foraminus structure including generally axially extending parallel bars 40 that are spaced apart from one another a distance sufficient to allow the passage of the first size fraction therethrough while substantially preventing the passage of the second size fraction therethrough. A power operated assembly 22 is provided for rotating the hollow drum 16 about its axis at a speed sufficient to cause a portion of the mixture entering the inlet and falling on the lowermost bars which has not passed through the spaces between the bars to be carried through a cycle which includes an upward movement with the movement of the bars and a falling movement downwardly onto the lowermost bars at a position downstream and a repetition of this cycle until the remaining mixture is moved out of the lower outlet end of the hollow drum. A first size fraction handling structure 26 is positioned below the hollow drum 16 and is constructed and arranged to receive the first size fraction passing through the spaces between the bars 40 as the mixture is cycled within the rotating hollow drum 16 and to move the first size fraction away. A second size fraction handling structure 30 is positioned at the outlet end of the hollow drum and is constructed and arranged to receive the remaining mixture moved out of the lower outlet end of the hollow drum and to move the remaining mixture away. A blockage clearing mechanism 58 is operatively associated with the upper exterior periphery of the hollow drum 16 and is constructed and arranged to move material lodged in the spaces between the bars 40 downwardly during the rotational movement of the hollow drum 16. Preferably, the blockage clearing mechanism 58 of the separator 10 is constructed and arranged for movement between an operative position in which the blockage clearing mechanism 58 is operatively associated with the drum 16 as aforesaid and an inoperative position in which the blockage clearing mechanism 58 is spaced from the drum 16. A plurality of axially extending mixture lifting structures 56 are preferably included in the separator 16 and are circumferentially spaced about an interior portion of the drum 16 for rotational movement therewith. Each mixture lifting structure 56 is constructed and arranged to lift the portion of the mixture falling on the lowermost bars 40 which has not passed through the spaces between the bars 40 upwardly with the upward movement of the bars 40 and to drop the portion downwardly onto the lowermost bars at a downstream position as each of the mixture lifting structures 56 reaches an upper portion of the drum interior.

Preferably, the separator 10 includes a central shroud 12 and an outlet shroud 14, the central shroud 12 generally surrounding the hollow drum 16 and being constructed and arranged to contain dust generated by the movement of the portion of the mixture within the drum. The central shroud 12 of the separator 10 includes a bottom opening constructed and arranged to direct stems falling through the bars 40 onto the tobacco stem handling structure 26. The outlet shroud 14 generally surrounds the outlet opening of the drum 16 and is constructed and arranged to contain the dust generated during drum 16 rotation and to direct the portion of the mixture that passes through the outlet opening onto the tobacco stalk particle handling structure 30.

OPERATION

Typically, the stalk removing apparatus 10 is used in a tobacco stemmery during a tobacco threshing and separating process. A tobacco mixture containing a stem fraction, a stalk fraction and possibly other non-tobacco impurities such as dirt is fed into the inlet opening 54 by the mixture handling structure 20. The mixture handling structure 20 usually receives the mixture from a conventional stem dryer used in an earlier tobacco processing step.

The mixture handling structure 20 places the mixture on the bars 40 at the bottom of and at the upstream end of the rotating drum 16 so that the mixture is carried the entire length of the drum by the rotational motion. As the power operated assembly 22 rotates the drum 16 about its axis, the longitudinally extending blades or flights 56 inside the drum 16 lift and then drop the mixture against the spaced bars at the bottom of the drum. Because the drum is slightly inclined, each time the mixture is dropped on the bottom of the drum, it is positioned slightly downstream of the position from which it was lifted. This causes a net flow of the mixture through the drum.

Each time the mixture is dropped on the bottom of the drum, a portion of the stem fraction falls through the spaces in the bars 40. The stems that pass through the bars 40 are directed onto the tobacco stem handling structure 26 by downwardly extending panels 70 on the central shroud 12. The tobacco stem handling structure 26 conveys the stems to the stem hopper. The rejection product remains in the drum until it passes out the outlet opening onto the tobacco stalk particle handling structure 30 which conveys the rejection product to the collection hopper 32 for disposal.

The greater the angle of incline of the axis of rotation of the drum, the farther downstream the mixture is dropped by the blades during a given rotational cycle of the drum 16. As stated above, the preferred angle of incline is five degrees. The preferred range of rotational speeds of the drum for this incline angle is 12 to 18 rpm. It can be appreciated that the flow rate of the mixture through the drum depends on the rotational speed of the drum and the angle of the incline. Because the power operated assembly 22 includes a variable speed electric motor, the rotational speed of the drum can be varied to achieve the desired rate of flow through the drum for a given angle of inclination. Too slow a speed will allow too much accumulation of the stems in the drum and too fast a speed will not allow the stems to drop because of centrifugal force.

In general, the variable speed motor rotates the drum 16 at a speed sufficient to cause a portion of the mixture entering the inlet opening 54 and falling on the lowermost parallel bars 40 that does not pass through the spaces between the parallel bars 40 to be carried through a cycle that includes an upward movement with the movement of the blades 56 on the parallel bars 40 and a falling movement downwardly onto the parallel bars 40 at a position slightly downstream of the position at which the blades 56 picked the mixture up from the bottom of the drum at the beginning of the cycle. The cycle is repeated until the mixture is moved through the drum and out the outlet opening 28 in the downstream end of the drum.

The elongated gears 60 may be continuously engaged or may be raised and lowered automatically at predetermined intervals as required to keep the spaces between the parallel bars 40 clear of obstructions.

It can be understood from the foregoing description and from the figures that a method of separating tobacco stem particles from a mixture containing such particles and tobacco stalk particles obtained in a threshing and separating process employed in a tobacco stemmery is contemplated. The method utilizes a hollow drum 16 having a longitudinal axis, the drum 16 being mounted for rotational movement about its axis and the axis being disposed at a slight angle with respect to the horizontal so as to establish a higher inlet end and a lower outlet end of the hollow drum 16. The hollow drum has a periphery formed of a foraminus structure including generally axially extending parallel bars 40 spaced apart a distance sufficient to allow the passage of tobacco stem particles therethrough while substantially preventing the passage of tobacco stalk particles therethrough. The method can be understood as comprising (1) feeding to the inlet end of the hollow drum 16 a supply of a mixture containing tobacco stem particles and tobacco stalk particles obtained in a threshing and separating process employed in a tobacco stemmery; (2) moving the mixture with respect to the hollow drum 16 by rotating the hollow drum 16 about its axis at a speed sufficient to cause a portion of the mixture entering the inlet and falling on the lowermost bars 40 which has not passed through the spaces between the bars 40 to be carried through a cycle which includes an upward movement with the movement of the bars 40 and a falling movement downwardly onto the lowermost bars 40 at a position downstream and a repetition of this cycle until the remaining mixture is moved out of the lower outlet end of the hollow drum 16; (3) receiving the tobacco stem particles passing through the spaces between the bars 40 as the particles of the mixture are cycled within the rotating hollow drum 16 and moving the tobacco stem particles away, and (4) receiving the remaining mixture moved out of the lower outlet end of the hollow drum 16 and moving the remaining mixture away. The method may include feeding the supply of mixture to the inlet end of the hollow drum from a stem dryer. It is contemplated that the method further utilizes a blockage clearing mechanism 58 that is operatively associated with an upper exterior periphery of the hollow drum 16, the blockage clearing mechanism 58 being constructed and arranged to move particles lodged in the spaces between the bars 40 downwardly during the rotational movement of the drum 16, and that the method further includes moving particles lodged in the spaces between the bar 40 downwardly during the rotational movement of the drum with the blockage clearing mechanism 58.

The method can be carried out by providing the drum 16 with a plurality of axially extending mixture lifting structures 56 that are circumferentially spaced about an interior portion of the drum for rotational movement therewith, each mixture lifting structure 56 being constructed and arranged to lift the portion of the mixture falling on the lowermost bars 40 which has not passed through the spaces between the bars 40 upwardly with the upward movement of the bars 40 and to drop the portion downwardly onto the lowermost bars 40 at a downstream position as each of the mixture lifting structures 56 reaches an upper portion of the drum 56 interior. Preferably, the bars 40 are spaced apart to form longitudinal openings about three eighths of an inch wide around the periphery of the drum 40, the longitudinal axis of the drum 40 is inclined at about five degrees and the rotating of the drum is from approximately 12 to approximately 18 rpm.

An advantage of the apparatus 10 is that the tumbling action of the mixture within the rotating drum 16 on the dry stems dislodges any remaining attached leaf lamina. The dislodged leaf lamina is reclaimed as fines in a subsequent system designed for this purpose. Processing of the mixture in the apparatus produces clean, polished stems that are attractive to the customer.

While the invention has been disclosed and described with reference with a limited number of embodiments, it will be apparent that variations and modifications may be made thereto without departure from the spirit and scope of the invention. Therefore, the following claims are intended to cover all such modifications, variations, and equivalents thereof in accordance with the principles and advantages noted herein.

What is claimed is:

1. Apparatus for separating tobacco stem particles from a mixture containing such particles and tobacco stalk particles obtained in a threshing and separating process employed in a tobacco stemmery, said apparatus comprising a hollow drum having a longitudinal axis mounted for rotational movement about said axis, said axis being disposed at a slight angle with respect to the horizontal so as to establish a higher inlet end and a lower outlet end of said drum, mixture handling structure constructed and arranged with respect to the inlet end of said hollow drum to feed thereto a supply of a mixture containing tobacco stem particles and tobacco stalk particles obtained in a threshing and separating process employed in a tobacco stemmery, said hollow drum having a periphery formed of a foraminus structure including generally axially extending parallel bars spaced apart a distance sufficient to allow the passage of tobacco stem particles therethrough while substantially preventing the passage of tobacco stalk particles therethrough, said bars defining longitudinaly extending tobacco engaging surfaces on an interior of said tubular drum, a power operated assembly for rotating said hollow drum about its axis at a speed sufficient to cause a portion of the mixture entering the inlet and falling on the lowermost bars which has not passed through the spaces between the bars to be carried through a cycle which includes an upward movement with the movement of the bars and a falling movement downwardly onto the lowermost bars at a position downstream and a repetition of said cycle until the remaining mixture is moved out of the lower outlet end of said hollow drum, tobacco stem handling structure below said hollow drum constructed and arranged to receive the tobacco stem particles passing through the spaces between said bars as the particles of the mixture are cycled within the rotating hollow drum and move the tobacco stem particles away, and tobacco stalk particle handling structure at the outlet end of said hollow drum constructed and arranged to receive the remaining mixture moved out of the lower outlet end of said hollow drum and to move the remaining mixture away wherein a blockage clearing mechanism is operatively associated with the exterior periphery of said hollow drum constructed and arranged to move particles lodged in the spaces between said bars downwardly during the rotational movement of said hollow drum.

2. Apparatus as defined in claim 1 wherein said blockage clearing mechanism is constructed and arranged for movement between an operative position in which said blockage clearing mechanism is operatively associated with said drum as aforesaid and an inoperative position in which said blockage clearing mechanism is spaced from said drum.

3. Apparatus as defined in claim 2 wherein said blockage clearing mechanism is comprised of a plurality of elongated gears mounted on an upper portion of the exterior of said drum, said gears having teeth constructed and arranged to meshingly engage said bars and to extend into the spaces between said bars to move said lodged particles downwardly into the interior of said drum during said rotational movement of said drum.

4. Apparatus as defined in claim 1, further comprising a plurality of axially extending mixture lifting structures circumferentially spaced about an interior portion of said drum for rotational movement therewith, each said mixture lifting structure being constructed and arranged to lift said portion of the mixture falling on the lowermost bars which has not passed through the spaces between the bars upwardly with the upward movement of the bars and to drop said portion downwardly onto the lowermost bars at a downstream position as each of said mixture lifting structures reaches an upper portion of said drum interior.

5. Apparatus as defined in claim 4 wherein a blockage clearing mechanism is operatively associated with the upper exterior periphery of said hollow drum constructed and arranged to move particles lodged in the spaces between said bars downwardly during the rotational movement of said hollow drum.

6. Apparatus as defined in claim 5, wherein said longitudinal axis of said hollow drum is disposed at an angle of about five degrees and wherein said rotational speed of said drum is from approximately 12 to approximately 18 rpm.

7. Apparatus as defined in claim 6 wherein said bars are spaced apart to form longitudinal openings about three eighths of an inch wide around the periphery of said drum.

8. Apparatus as defined in claim 7 further comprising a central shroud and an outlet shroud, said central shroud generally surrounding said hollow drum and being constructed and arranged to contain dust generated by the movement of said portion of said mixture within said drum, said central shroud having a bottom opening constructed and arranged to direct stems falling through said bars onto said tobacco stem handling structure, and said outlet shroud generally surrounding said outlet opening and being constructed and arranged to contain said dust and to direct the portion of the mixture that passes through said outlet opening onto said tobacco stalk particle handling structure.

9. Apparatus as defined in claim 8 wherein said mixture handling structure is provided by a first conveyor belt assembly, wherein said tobacco stem handling structure is provided by a second conveyor belt assembly, said second conveyor belt assembly being constructed and arranged to move said stem particles away to a stem container, and wherein said tobacco stalk particle handling structure is provided by a third conveyor belt assembly, said third conveyor belt assembly being constructed and arranged to move said stalk particles away to a stalk container.

10. A method of separating tobacco stem particles from a mixture containing such particles and tobacco stalk particles obtained in a threshing and separating process employed in a tobacco stemmery utilizing a hollow drum having a longitudinal axis and being mounted for rotational movement about said axis, said axis being disposed at a slight angle with respect to the horizontal so as to establish a higher inlet end and a lower outlet end of said hollow drum, the hollow drum having a periphery formed of a foraminus structure including generally axially extending parallel bars spaced apart a distance sufficient to allow the passage of tobacco stem particles therethrough while substantially preventing the passage of tobacco stalk particles therethrough, said method comprising feeding to the inlet end of said hollow drum a supply of a mixture containing tobacco stem particles and tobacco stalk particles obtained in a threshing and separating process employed in a tobacco stemmery, moving said mixture with respect to said hollow drum by rotating said hollow drum about its axis at a speed sufficient to cause a portion of the mixture entering the inlet and falling on the lowermost bars which has not passed through the spaces between the bars to be carried through a cycle which includes an upward movement with the movement of the bars and a falling movement downwardly onto the lowermost bars at a position downstream and a repetition of said cycle until the remaining mixture is moved out of the lower outlet end of said hollow drum, receiving the tobacco stem particles passing through the spaces between said bars as the particles of the mixture are cycled within the rotating hollow drum and moving the tobacco stem particles away, and receiving the remaining mixture moved out of the lower outlet end of said hollow drum and moving the remaining mixture away.

11. The method as defined in claim 10, wherein said feeding comprises feeding said supply of said mixture to the inlet end of said hollow drum from a stem dryer.

12. The method as defined in claim 10, said method further utilizing a blockage clearing mechanism operatively associated with an upper exterior periphery of said hollow drum, said blockage clearing mechanism being constructed and arranged to move particles lodged in the spaces between said bars downwardly during the rotational movement of said drum, said moving of said mixture further comprising moving particles lodged in the spaces between said bar downwardly during the rotational movement of said drum with said blockage clearing mechanism.

13. The method as defined in claim 12, said drum further including a plurality of axially extending mixture lifting structures circumferentially spaced about an interior portion of said drum for rotational movement therewith, each said mixture lifting structure being constructed and arranged to lift said portion of the mixture falling on the lowermost bars which has not passed through the spaces between the bars upwardly with the upward movement of the bars and to drop said portion downwardly onto the lowermost bars at a downstream position as each of said mixture lifting structures reaches an upper portion of said drum interior.

14. The method as defined in claim 13, wherein said bars are spaced apart to form longitudinal openings about three eighths of an inch wide around the periphery of said drum, wherein said longitudinal axis of said drum is inclined at about five degrees and wherein said rotating of said drum is from approximately 12 to approximately 18 rpm.

15. A separator comprising a hollow drum having a longitudinal axis mounted for rotational movement about said axis, said axis being disposed at a slight angle with respect to the horizontal so as to establish a higher inlet end and a lower outlet end of said drum, feeding structure constructed and arranged with respect to the inlet end of said hollow drum to feed thereto a supply of a mixture containing first and second size fractions, said hollow drum having a periphery formed of a foraminus structure including generally axially extending parallel bars spaced apart a distance sufficient to allow the passage of the first size fraction therethrough while substantially preventing the passage of the second size fraction therethrough, said bars defining longitudinally extending tobacco engaging surfaces on an interior of said tubular drum, a power operated assembly for rotating said hollow drum about its axis at a speed sufficient to cause a portion of the mixture entering the inlet and falling on the lowermost bars which has not passed through the spaces between the bars to be carried through a cycle which includes an upward movement with the movement of the bars and a falling movement downwardly onto the lowermost bars at a position downstream and a repetition of said cycle until the remaining mixture is moved out of the lower outlet end of said hollow drum, a first size fraction handling structure below said hollow drum constructed and arranged to receive the first size fraction passing through the spaces between said bars as the mixture is cycled within the rotating hollow drum and move the first size fraction away, and second size fraction handling structure at the outlet end of said hollow drum constructed and arranged to receive the remaining mixture moved out of the lower outlet end of said hollow drum and move the remaining mixture away, and a blockage clearing mechanism operatively associated with the upper exterior periphery of said hollow drum constructed and arranged to move material lodged in the spaces between said bars downwardly during the rotational movement of said hollow drum.

16. A separator as defined in claim 15 wherein said blockage clearing mechanism is constructed and arranged for movement between an operative position in which said blockage clearing mechanism is operatively associated with said drum as aforesaid and an inoperative position in which said blockage clearing mechanism is spaced from said drum.

17. A separator as defined in claim 16, further comprising a plurality of axially extending mixture lifting structures circumferentially spaced about an interior portion of said drum for rotational movement therewith, each said mixture lifting structure being constructed and arranged to lift said portion of the mixture falling on the lowermost bars which has not passed through the spaces between the bars upwardly with the upward movement of the bars and to drop said portion downwardly onto the lowermost bars at a downstream position as each of said mixture lifting structures reaches an upper portion of said drum interior.

18. A separator as defined in claim 17, wherein said longitudinal axis of said hollow drum is disposed at an angle of about five degrees, wherein said rotational speed of said drum is from approximately 12 to approximately 18 rpm and wherein said bars are spaced apart to form longitudinal openings about three eighths of an inch wide around the periphery of said drum.

19. A separator as defined in claim 18 further comprising a central shroud and an outlet shroud, said central shroud generally surrounding said hollow drum and being constructed and arranged to contain dust generated by the movement of said portion of said mixture within said drum, said central shroud having a bottom opening constructed and arranged to direct stems falling through said bars onto said tobacco stem handling structure, and said outlet shroud generally surrounding said outlet opening and being constructed and arranged to contain said dust and to direct the portion of the mixture that passes through said outlet opening onto said tobacco stalk particle handling structure.

* * * * *